US006464859B1

(12) United States Patent
Duncum et al.

(10) Patent No.: US 6,464,859 B1
(45) Date of Patent: Oct. 15, 2002

(54) PROCESS FOR DEACIDIFYING A CRUDE OIL SYSTEM

(75) Inventors: Simon Neil Duncum, Bracknell; Christopher George Osborne, Sandhurst, both of (GB)

(73) Assignee: BP Exploration Operating Company, Ltd., London (GB)

( * ) Notice: Subject to any disclaimer, the term of this patent is extended or adjusted under 35 U.S.C. 154(b) by 0 days.

(21) Appl. No.: 09/649,234

(22) Filed: Aug. 29, 2000

Related U.S. Application Data

(63) Continuation of application No. PCT/GB99/04387, filed on Dec. 23, 1999.

(30) Foreign Application Priority Data

Feb. 4, 1999 (GB) ..... 9902518

(51) Int. Cl.[7] ..... C10G 19/02
(52) U.S. Cl. ..... 208/263; 208/284; 208/45
(58) Field of Search ..... 208/263, 284, 208/45

(56) References Cited

U.S. PATENT DOCUMENTS 3,761,534 A * 9/1973 Sun et al. ..... 260/674 A
3,776,309 A * 12/1973 Murray et al. ..... 166/273
4,144,266 A * 3/1979 Plummer et al. ..... 260/505 S
4,634,519 A 1/1987 Danzik ..... 208/263

OTHER PUBLICATIONS

Database WPI, Derwent Publications Ltd., 1994–026758; XP002134075. no month.
Database WPI, Derwent Publications Ltd., 1989–197264; XP002134076. no month.
Database WPI, Derwent Publications Ltd., 1993–036862; XP002134077. no month.

* cited by examiner

*Primary Examiner*—Nadine Preisch
(74) *Attorney, Agent, or Firm*—Nixon & Vanderhye

(57) ABSTRACT

This invention relates to a process for deacidifying a crude oil system, said process comprising the steps of:

a) contacting the crude oil system with a polar solvent, such that at least part of the organic acid present in the oil is extracted into the solvent as an extract phase, and
b) separating said extract phase from the treated crude oil system of step a).

8 Claims, No Drawings

PROCESS FOR DEACIDIFYING A CRUDE OIL SYSTEM

This is a continuation of PCT application No. PCT/GB99/04387, filed Dec. 23, 1999, the entire content of which is hereby incorporated by reference in this application.

This invention relates to a process of deacidifying crude oil.

Crude oil and distilled fractions thereof may contain amounts of organic acids, such as naphthenic acid, making it somewhat acidic. The acidity of crude oil is measured in terms of its Total Acid Number (TAN): this is defined as the amount of potassium hydroxide in milligrams (mg) required to neutralise 1 g of oil. Typically, the TAN of acidic crude oil lies between 0.5 and 7.0. The acid impurities in crude oil can cause corrosion problems, particularly in refinery operations where temperatures of 200° C. and above are encountered. For this reason, it is desirable to reduce the TAN, for example, by reducing the amount of naphthenic acid present.

Various methods for deacidifying crude oil are known. For example, in a conventional deacidification process crude oil is treated with a base, which reacts with the organic acid present in the crude oil to produce a salt and water. When sodium hydroxide is used as a base, water and a salt such as sodium napthenate is produced. The sodium napthenate may be isolated and converted to naphthenic acid and sodium chloride using HCl. However, to reduce the acidity of the oil to acceptable levels, large amounts of sodium hydroxide and HCI are consumed. Moreover, the process generates a large amount of sodium chloride, which must be isolated via a number of cumbersome separation steps and then disposed of As a result, this process is relatively uneconomic, and because of the very large volumes of oil involved, produces a considerable amount of waste.

We have developed a method of deacidifying crude oil by solvent-extraction with a polar solvent which can employ cheaper materials than the above process, and produce less waste.

According to the present invention, there is provided a process for deacidifying a crude oil system, said process comprising the steps of:

a) contacting the crude oil system with a polar solvent, such that at least part of the organic acid present in the oil is extracted into the solvent as an extract phase, and
b) separating said extract phase from the treated crude oil system of step a).

In the present application, "crude oil system" means a crude oil of a particular composition and/or origin, or a mixture of crude oils of different compositions and/or origins.

The present invention removes organic acid from crude oil system by solvent extraction. Examples of organic acids that may be present in the crude oil system include phenols, sulphur-containing acids, and most commonly, naphthenic acid. Organic acids like naphthenic acid have higher affinities for polar solvents than crude oil systems and, accordingly, will selectively dissolve in the solvent as an extract phase. The extract phase is immiscible with the remainder of the crude oil system, and can be separated by decanting and/or distillation. Once separated, the solvent may be recovered from the extract phase and re-used. The isolated organic acids may be used in a number of applications, for example, in the production of detergents, or as a solvent for metal ions. The direct production of organic acid and also the ability to recycle the solvent make the process of the present invention particularly efficient, both economically and in terms of the amount of waste generated.

The process of the present invention is particularly useful for reducing the Total Acid Number (TAN) of acidic crude oil to 0.9 and below, preferably 0.5 and below, and most preferably 0.3 and below.

The process of the present invention may be performed on a crude oil system one or more times. Preferably, the process is repeated until the Total Acid Number (TAN) of the crude oil system is reduced to 0.9 or less, most preferably, to 0.5 or less, and especially, to 0.3 or less. This may require the process to be repeated a number of times, for example, six times. Preferably, however, the TAN value of the crude oil system is reduced to a desirable value after the process has been repeated three times or less.

The process of the present invention may be carried out using a polar solvent. Suitable solvents include alcohols, alcohol derivatives and ethers. Suitable alcohols include methanol, ethanol and propanol, with methanol being preferred. Glycols such as polyethylene glycol may also be suitable. Suitable ethers include glycol ethers. Alcohol derivatives such as alcohol polyalkoxylate may also be employed. Mixtures of solvents (eg water and methanol) may also be used.

The ratio of solvent to crude oil employed may be 1:99 to 80:20, preferably, 20: 80 to 60:40, for example, 30:70 to 50:50.

In one embodiment of the present invention, the present process further comprises the step of c) treating the treated crude oil system of step a) with a base. This step is particularly useful for reducing the TAN values of crude oil systems whose TAN values remain above a desired value, despite repeated washes with a polar solvent. Because the acidity of the crude oil system has already been reduced by solvent extraction with a polar solvent, relatively small amounts of base are required for neutralisation.

Suitable bases for step c) include alkali and alkaline earth metal hydroxides, such as sodium hydroxide. For example, when sodium hydroxide is employed, water and a salt such as sodium naphthenate may be produced. Sodium naphthenate may be converted into naphthenic acid, for example, by the addition of a mineral acid like HCl. Naphthenic acid is a valuable product.

The process of the invention may be carried out on a crude oil pipeline. Part or all of the oil flowing through the pipeline is delivered into a mixing chamber where it is contacted with the solvent: typically a counter-current extraction column may be used, with oil entering at one end and the solvent at the other. After mixing, the two phases are separated, and the oil either returned to the pipeline or subjected to further treatment, whilst the solvent is recycled.

The process of the present invention may also be carried out on a tanker. Thus, the present process may be employed to deacidify a crude oil whilst the crude oil is being transported from one place to another.

These and other aspects of the present invention will now be described with reference to the following Examples.

EXAMPLES 1–6

In these Examples, known weights of methanol and crude oil were added to a separating funnel. The funnel was stopped, shaken for 2 minutes to form an emulsion and then placed into an oven at 40° C. overnight to allow the mixture to separate. After 16 hours, the mixture was observed to have separated into two phases: a crude oil bottom phase, and a methanol top phase. The phases were separated, weighed, and a subsample of each phase was taken and analysed for Total Acid Number (TAN). The acidic components of the crude oil were dissolved in the methanol bottom phase. Once separated, the methanol bottom phase was optionally purified for re-use. Suitable methods for recovering methanol from the bottom phase include distillation. Alternatively, separation membranes may be employed.

The washed crude oil was then returned to the separating funnel, together with a known weight of clean methanol. The funnel was stopped, shaken for 2 minutes to form a emulsion and then placed into a oven at 40° C. overnight to separate. As before, after 16 hours, the mixture was observed to have separated into two phases. The phases were separated, weighed and analysed for TAN. This washing procedure was repeated until crude oil TAN values of 0.9 or below were observed. The conditions employed in this Example are summarised below:

Mixing Time=Hand shaken 2 minutes

Mixing Ratio=50:50

Temperature=40° C.

North Sea Crude oils

Crude oil example 1 (100%)

| | Tan Number of each phase (mg KOH/g of sample) after wash | |
|---|---|---|
| | Oil | Methanol |
| Wash 0 (Blank) | 2.77 | 0 |
| Wash 1 | 2.14 | 0.98 |
| Wash 2 | 1.52 | 0.41 |
| Wash 3 | 1.22 | 0.23 |
| Wash 4 | 1.04 | 0.14 |
| Wash 5 | 0.94 | 0.09 |
| Wash 6 | 0.90 | 0.07 |

Process efficiency after 4 methanol washes = 62%

Crude oil example 2 (Mixture)

| | Tan Number of each phase (mg KOH/g of sample) after wash | |
|---|---|---|
| | Oil | Methanol |
| Wash 0 (Blank) | 0.80 | 0 |
| Wash 1 | 0.45 | 0.28 |
| Wash 2 | 0.37 | 0.21 |
| Wash 3 | 0.35 | 0.05 |
| Wash 4 | N/A | N/A |

Process efficiency after 3 methanol washes = 56%

Crude oil example 3 (100%)

| | Tan Number of each phase (mg KOH/g of sample) after wash | |
|---|---|---|
| | Oil | Methanol |
| Wash 0 (Blank) | 1.66 | 0 |
| Wash 1 | 1.27 | 0.41 |
| Wash 2 | 1.05 | 0.23 |

-continued

| | | |
|---|---|---|
| Wash 3 | 0.91 | 0.12 |
| Wash 4 | 0.84 | 0.09 |

Process efficiency after 4 methanol washes = 49%

West Africa Crude Oils

Crude oil example 4 (100%)

| | Tan Number of each phase (mg KOH/g of sample) after wash | |
|---|---|---|
| | Oil | Methanol |
| Wash 0 (Blank) | 0.97 | 0 |
| Wash 1 | 0.51 | 0.44 |
| Wash 2 | 0.37 | 0.16 |
| Wash 3 | 0.29 | 0.08 |
| Wash 4 | 0.24 | 0.03 |

Process efficiency after 4 methanol washes = 75%

Crude oil example 5 (100%)

| | Tan Number of each phase (mg KOH/g of sample) after wash | |
|---|---|---|
| | Oil | Methanol |
| Wash 0 (Blank) | 1.41 | 0 |
| Wash 1 | 0.58 | 0.83 |
| Wash 2 | 0.36 | 0.24 |
| Wash 3 | 0.24 | 0.11 |
| Wash 4 | 0.18 | 0.05 |

Process efficiency after 4 methanol washes = 87%

GOM Crude Oil crude oil example 6 (100%)

| | Tan Number of each phase (mg KOH/g of sample) after wash | |
|---|---|---|
| | Oil | Methanol |
| Wash 0 (Blank) | 0.83 | 0 |
| Wash 1 | 0.43 | 0.36 |
| Wash 2 | 0.29 | 0.11 |
| Wash 3 | 0.25 | 0.04 |
| Wash 4 | 0.23 | 0.04 |

Process efficiency after 4 methanol washes = 72%

The results above show that the TAN levels of various different types of crude oil can be reduced to acceptable levels by solvent extraction with methanol. It will be understood, however, that in cases where it is desired to reduce the crude oil TAN levels further, alkali may be added to the crude oil after the crude oil has been solvent extracted at least once with methanol.

EXAMPLE 7

In this example, crude oil samples were mixed with a range of solvents for 2 minutes at high shear. The following solvents were used:

1) a mixture of aliphatic alcohol polyalkoxylates
2) a mixture of polyethylene glycol
3) a glycol ether mixture The samples were then placed in an oven at 70° C. After 16 hours, the mixture was observed to have separated into two phases: a crude oil bottom phase, and a solvent top phase. In some cases, the crude oil bottom phase was treated with NaOH.

Table 1 below summarises the conditions employed.

TABLE 1

| Sample No. | Crude oil type | Solvent | Mixing Ratio | Addition of NaOH to Neutralise | Separation (2 phases) | Solvent losses % (estimated) |
|---|---|---|---|---|---|---|
| 1 | Harding | 1 | 50:50 | Yes | Yes | 40 |
| 2 | Harding | 1 | 50:50 | No | Yes | 40 |
| 3* | Harding | 2 | 50:50 | Yes | Yes | Minimum |
| 4* | Harding | 2 | 50:50 | No | Yes | Minimum |
| 5 | Harding | 3 | 50:50 | Yes | Yes | 40 |
| 6 | Harding | 3 | 50:50 | No | Yes | 40 |
| 7 | FPS/Harding (90:10) | 1 | 50:50 | Yes | Yes | 40 |
| 8 | FPS/Harding (90:10) | 1 | 50:50 | No | Yes | 40 |
| 9* | FPS/Harding (90:10) | 2 | 50:50 | Yes | Yes | Minimum |
| 10* | FPS/Harding (90:10) | 2 | 50:50 | No | Yes | Minimum |
| 11 | FPS/Harding (90:10) | 3 | 50:50 | Yes | Yes | 100 |
| 12 | FPS/Harding (90:10) | 3 | 50:50 | No | Yes | 100 |

The bottom and top phases obtained for Samples 3, 4, 9 and 10 were separated, weighed, analysed. The results are shown in Table 2 below.

TABLE 2

| Sample No. | Phase | TAN (mg/KOH/g of oil) | Na Conc. (ppm) |
|---|---|---|---|
| 3 | solvent | Slightly Alkaline | 830 |
| 3 | Oil | 0.06 | 340 |
| 4 | solvent | 0.45 | 23 |
| 4 | Oil | 2.42 | 0.8 |
| 9 | solvent | Slightly Alkaline | N/A |
| 9 | Oil | 0.07 | N/A |
| 10 | solvent | 0.07 | N/A |
| 10 | Oil | 0.28 | N/A |
| Blank | Oil | 0.36 | N/A |

The TAN of untreated Harding is 2.78. The TAN of untreated FPS/Harding (90:10) is 0.36

The oil fraction of sample 10 was re-extracted a further three times, using a fresh solvent 2 each time. The extraction was carried out in the absence of NaOH, using a mixing ratio of 50:50. The results are shown in Table 3 below.

TABLE 3

| | wash 1 | wash 2 | wash 3 | wash 4 |
|---|---|---|---|---|
| TAN (mg/KOH/g of oil) of oil fraction | 0.28 | 0.23 | 0.19 | 0.16 |

TABLE 3-continued

| | wash 1 | wash 2 | wash 3 | wash 4 |
|---|---|---|---|---|
| TAN (mg/KOH/g of oil) of solvent fraction | 0.07 | 0.05 | 0.04 | 0.03 |

What is claimed is:

1. A process for deacidifying a crude oil system, said process comprising the steps of:

a) contacting the crude oil system with a polar solvent selected from the group consisting of alcohols, alcohol polyalkoxylates and ethers, such that at least part of the organic acid present in the oil is extracted into the solvent as an extract phase, and b) separating said extract phase from the treated crude oil system of step a).

2. A process as claimed in claim 1, wherein steps a) and b) are repeated one or more times.

3. A process as claimed in claim 1, wherein the polar solvent is selected from the group consisting of methanol, ethanol, propanol, polyethylene glycol, glycol ether, and alcohol polyalkoxylate.

4. A process as claimed in claim 1, wherein the ratio of solvent to crude oil system is 1:99 to 80:20.

5. A process as claimed in claim 1, which further comprises the step of c) treating the extract phase of step b) with a base.

6. A process as claimed in claim 5, wherein the base in NaOH.

7. A process as claimed in claim 1, which is carried out on a crude oil pipeline.

8. A process as claimed in claim 1, which is carried out on a tanker.

* * * * *

UNITED STATES PATENT AND TRADEMARK OFFICE

CERTIFICATE OF CORRECTION

PATENT NO. : 6,464,859 B1
DATED : October 15, 2002
INVENTOR(S) : Duncum et al.

It is certified that error appears in the above-identified patent and that said Letters Patent is hereby corrected as shown below:

Column 6,
Line 52, please delete "the extract phase of step b)" and replace by -- treated crude oil system --.

Signed and Sealed this

First Day of April, 2003

JAMES E. ROGAN
*Director of the United States Patent and Trademark Office*